US008850772B1

(12) United States Patent
Stanfill

(10) Patent No.: US 8,850,772 B1
(45) Date of Patent: Oct. 7, 2014

(54) INTERLOCKING CLADDING PANEL TRIM PIECES AND METHODS OF USE

(71) Applicant: Rustique Enterprises, Inc., O'Fallon, MO (US)

(72) Inventor: Heath Stanfill, Foristell, MO (US)

(73) Assignee: Rustique Enterprises, Inc., O'Fallon, MO (US)

( * ) Notice: Subject to any disclaimer, the term of this patent is extended or adjusted under 35 U.S.C. 154(b) by 0 days.

(21) Appl. No.: 13/832,822

(22) Filed: Mar. 15, 2013

(51) Int. Cl.
*E04D 3/362* (2006.01)
*E04D 1/34* (2006.01)
*E04F 13/08* (2006.01)

(52) U.S. Cl.
CPC ..... *E04F 13/0894* (2013.01); *E04D 3/362* (2013.01); *E04D 1/34* (2013.01)
USPC ..... 52/520; 52/543

(58) Field of Classification Search
USPC ..... 52/518, 519, 520, 543, 545, 552, 478, 52/586.1, 586.2
See application file for complete search history.

(56) References Cited

U.S. PATENT DOCUMENTS 3,412,516 A * 11/1968 Lindström ..... 52/506.1
4,134,244 A * 1/1979 Sjolander ..... 52/506.1
4,189,885 A 2/1980 Fritz
5,016,415 A 5/1991 Kellis
5,090,174 A 2/1992 Fragale
5,878,543 A * 3/1999 Mowery ..... 52/519
7,562,505 B2 * 7/2009 Tohanczyn, Jr. ..... 52/539
8,091,313 B2 * 1/2012 Wilson et al. ..... 52/534
2002/0029537 A1 * 3/2002 Manning et al. ..... 52/518
2006/0075712 A1 4/2006 Gilbert et al.
2006/0272257 A1 12/2006 Hobbie
2007/0119107 A1 5/2007 Shaw et al.
2007/0193177 A1 8/2007 Wilson et al.

* cited by examiner

*Primary Examiner* — William Gilbert
*Assistant Examiner* — Kyle Walraed-Sullivan
(74) *Attorney, Agent, or Firm* — Thompson Coburn LLP

(57) ABSTRACT

Trim pieces for siding include an anchor trim piece and an exterior face piece. The anchor trim piece has a mounting portion for mounting to a structure and an interlocking portion. The mounting portion is perpendicular to the interlocking portion. The exterior trim piece has a first exterior face portion and an interlocking portion. The interlocking portion is generally transverse to the exterior face portion. The exterior trim piece interlocking portion is resilient and has a cooperating geometry with the anchor trim piece interlocking portion such that the exterior trim piece is enabled to be assembled with the anchor trim piece by engaging the exterior trim piece interlocking portion with the anchor trim piece interlocking portion. The anchor trim piece interlocking portion is perpendicular to the plane defined by the first exterior face portion when the exterior trim piece and anchor trim piece are assembled together.

22 Claims, 9 Drawing Sheets

INTERLOCKING CLADDING PANEL TRIM PIECES AND METHODS OF USE

BACKGROUND AND SUMMARY

The following disclosure relates to interlocking siding, and associated trim pieces, used in siding construction on a structure. The siding has an outer layer with front and rear surfaces. The front layer is exposed and the rear layer has an insulating layer mounted thereto. The panels may be arranged generally vertical on the structure. The trim pieces cooperate with the siding pane for aesthetic mounting of the trim pieces and siding panel to the structure.

DETAILED DESCRIPTION

Figure 1:
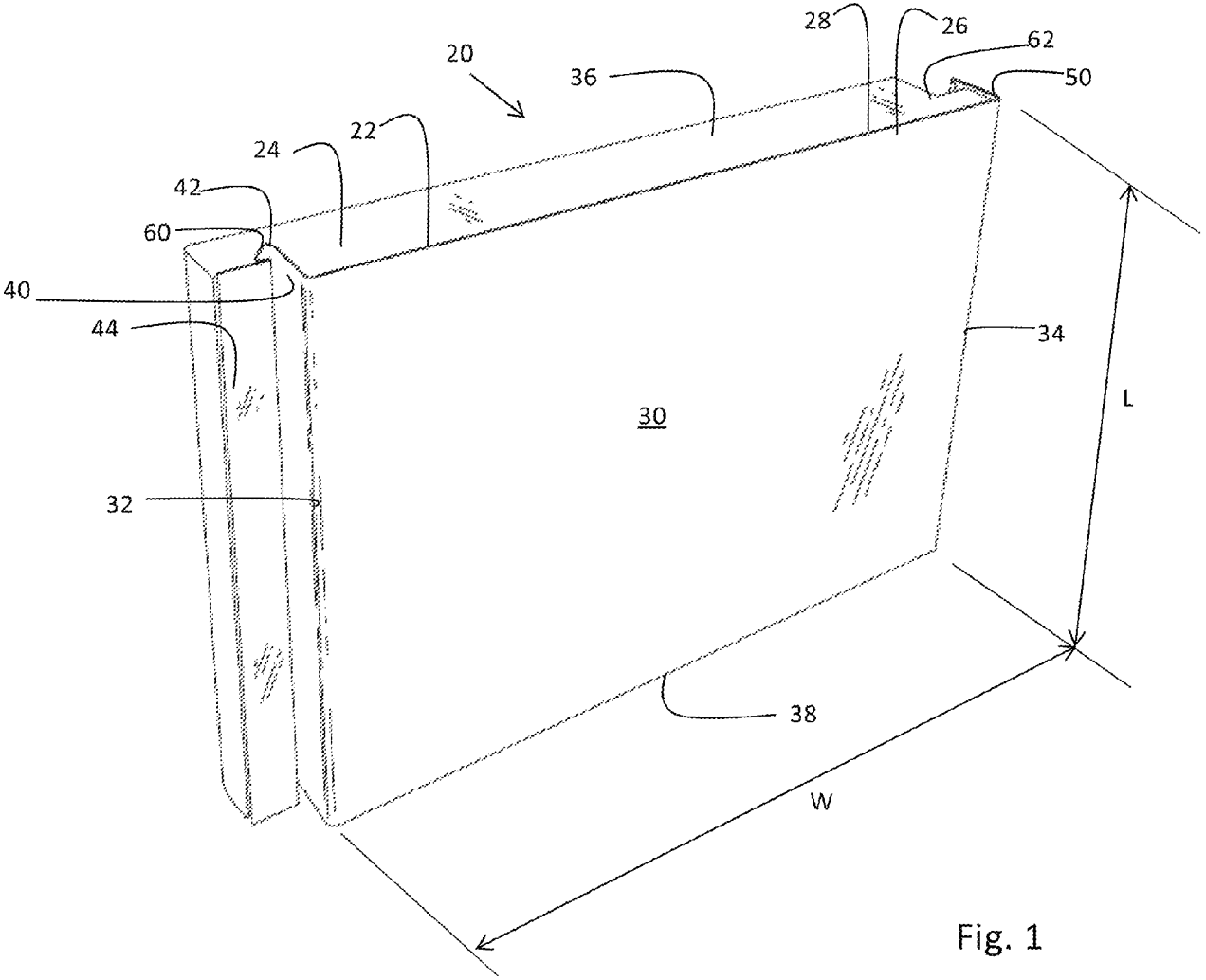
FIG. 1 shows a perspective view of a section of an interlocking cladding panel as described herein.
Figure 2:
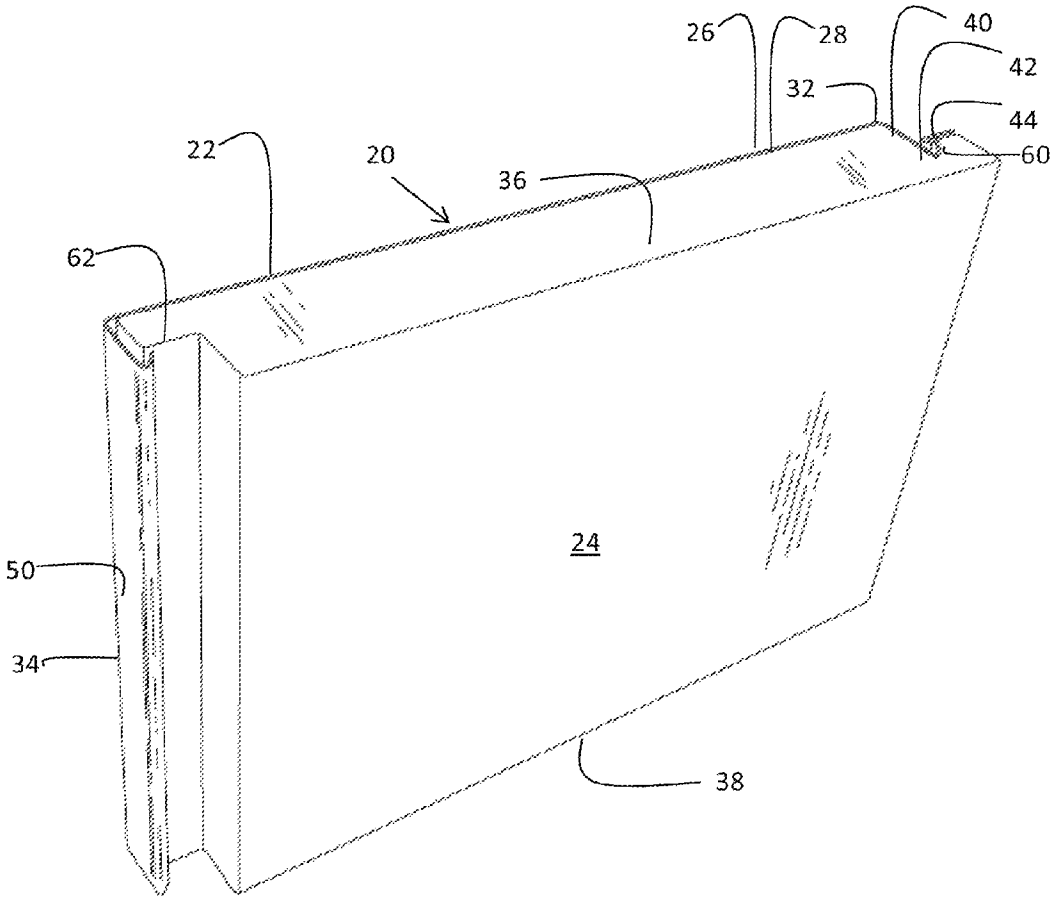
FIG. 2 shows an alternate perspective view of the section of the panel of FIG. 1.
Figure 5:
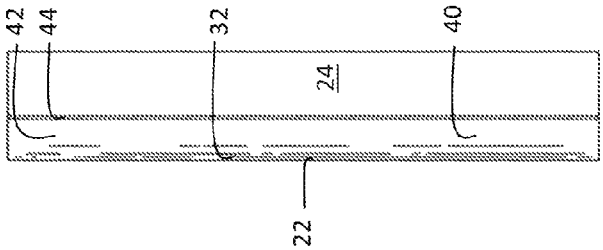
FIG. 5 shows a right side view of the section of the panel of FIG. 1.

As used herein, the terms "left," "right", "top," "bottom", "front," and "rear" are used for convenience of describing elements in the views of the drawings and are not meant to be limiting in any sense.

An interlocking panel 20 is used for a siding construction on a structure 100. The panel 20 has an outer layer 22 and an insulating layer 24. The outer layer 22 has front and rear surfaces 26, 28, and the insulating layer 24 is mounted to the rear surface 28 of the outer layer. The insulating layer 24 may be bonded or adhered to the rear surface 28 of the outer layer 22. The insulating layer may provide the panel with an insulation value of R-10. A portion of the outer layer front surface

26 forms a panel face 30. The panel face 30 is preferably flat and defines a plane. The panel face 30 may be exposed when mounted on the structure with the insulating layer disposed against the structure. The outer layer front surface may have a surface texture resembling wood or stone as may be desired. The outer layer 30 may be formed from vinyl or aluminum or other material commonly used for siding construction on a structure.

The panel 20 has a length L and a width W. When mounted on the structure, the panel may be arranged such that the length L is generally vertical relative to the structure and the width W is generally horizontal relative to the structure. The length L has opposite first and second longitudinal sides 32, 34 extending along the panel length L. The longitudinal sides are spaced apart to generally define the panel width W. The panel 20 also has opposite first and second lateral sides 36, 38 extending across the panel width W. The first and second lateral sides 36, 38 are spaced apart and generally define the panel length L. As shown in the drawings, the lateral sides 36, 38 form the top and bottom peripheral edges of the panel and the longitudinal sides 32, 34 form the left and right peripheral edges. The section of panel shown in the drawings is illustrative and may have any length L or width W and is not limited to the dimensions or relative scale shown in drawings. The length L may be a length approximating the height of a typical one story as used in construction so that one panel may be used to cover the entire height of the story. The width W may be any convenient width considering handling, weight or manufacturing requirements.

Figure 3:
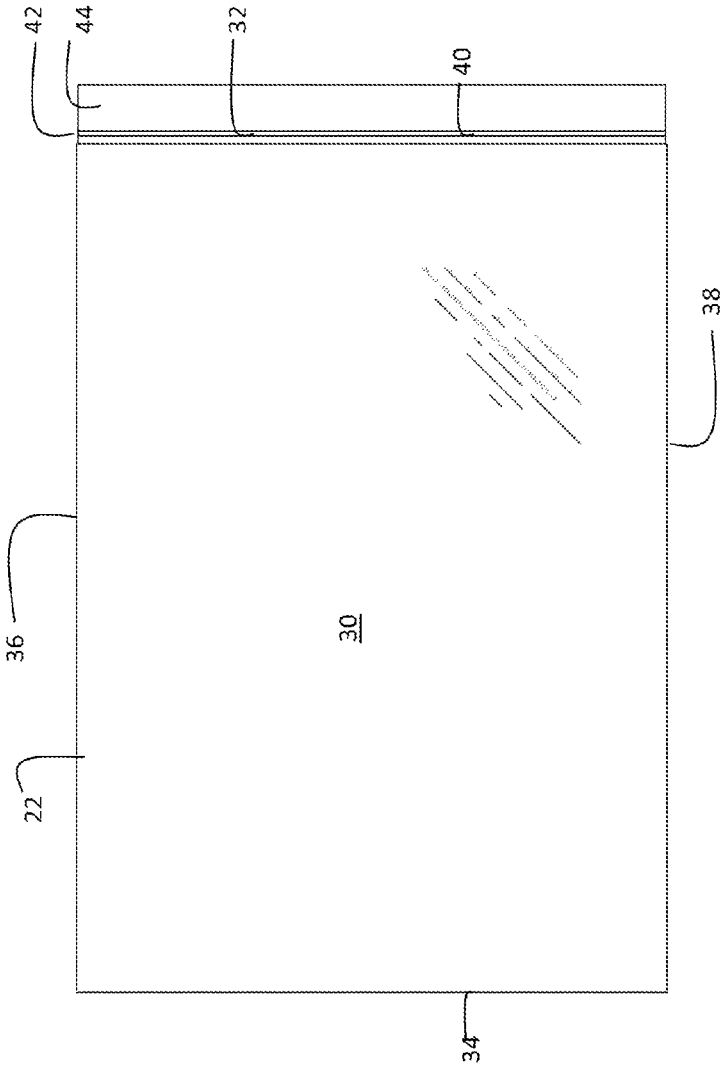
FIG. 3 shows a front view of the section of the panel of FIG. 1.
Figure 4:
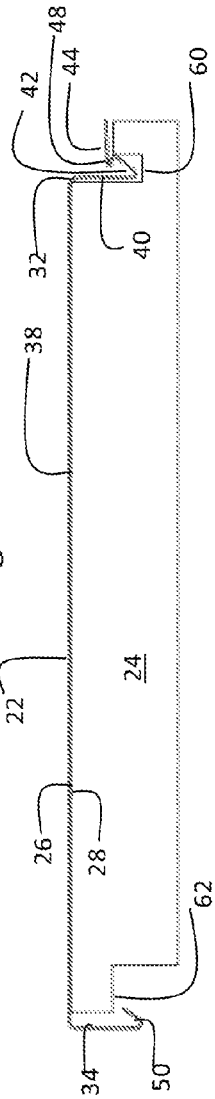
FIG. 4 shows a top view of the section of the panel of FIG. 1.
Figure 6:
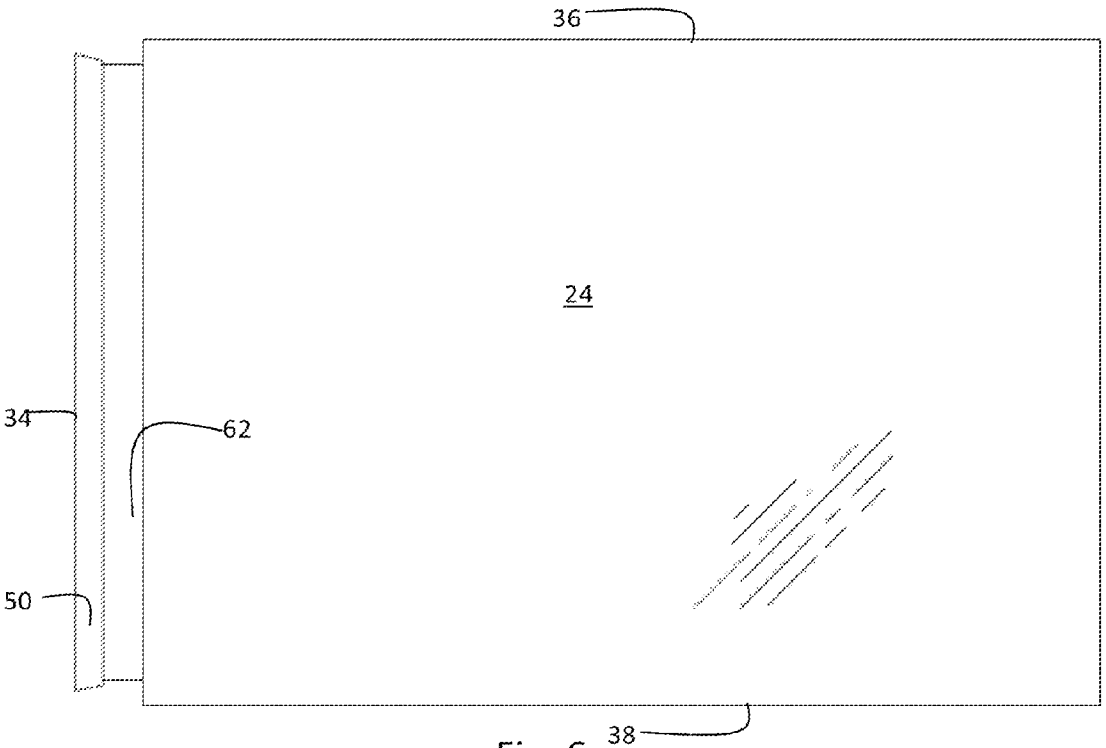
FIG. 6 shows a rear view of the section of the panel of FIG. 1.
Figure 7:
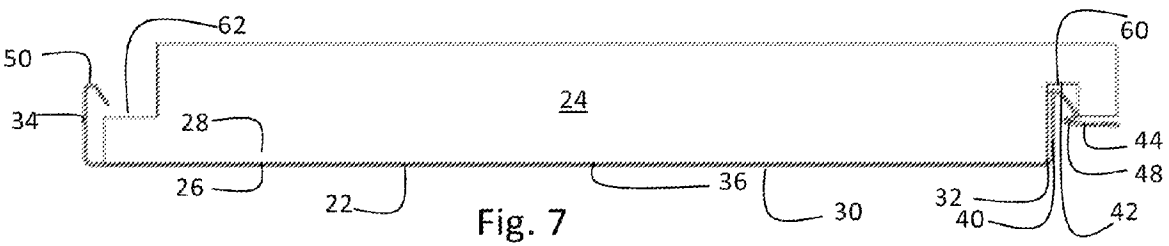
FIG. 7 shows a bottom view of the section of the panel of FIG. 1.
Figure 8:
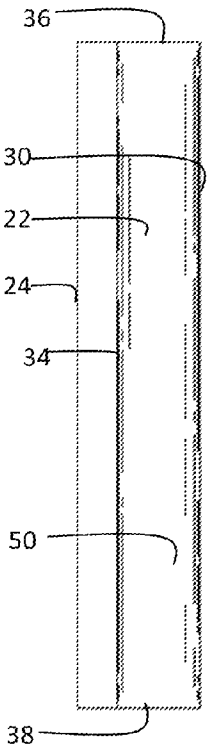
FIG. 8 shows a left side view of the section of the panel of FIG. 1.

The panel first longitudinal edge (i.e., the "right" edge in FIGS. 3 and 4) may have a web 40 disposed generally transverse to the panel face 30. The panel face 30 may be flat and define a plane, and the web 40 may be perpendicular to the panel face. The web 40 may extend in a direction perpendicular to the panel face rearwardly toward the inner insulating layer 24. As shown in the drawings, the outer layer 22 is formed to bend around the insulating layer to define the first longitudinal edge 32 of the panel and comprise the web 40. The web may extend outward from the longitudinal edge 32. The web may have an interlocking groove portion 42. The outer layer 22 may extend from the panel face 30 rearwardly toward the inner insulating layer 24 and after a certain rearward distance reverse directions back toward the front surface 26 of the panel at an acute angle away from the panel longitudinal edge 32 to form the interlocking groove portion 42 with a triangular or tapered cross-section. The first longitudinal edge web 40 may also have a mounting surface portion 44 to enable the panel to be mounted on the structure. The mounting surface portion 44 may be formed in a plane parallel to the plane defined by the panel face 30. The mounting surface portion 44 may have fastener holes (not shown) that extend through the mounting surface portion and a portion of the insulating layer directly behind the mounting surface portion. Alternatively, the mounting surface may be punctured. Mechanical fasteners 46 (FIGS. 9-16) such as screws or nails may be directed through the mounting surface portion to secure the panel to the structure 100. The outer layer 22 may be formed to extend at an acute angle after the interlocking groove portion 42 to form the mounting surface portion 44. A locking projection 48 may also be formed between the groove portion 42 and the mounting portion 44.

The second longitudinal edge 34 (i.e., the left edge in FIGS. 3,4) of the panel 20 may have an interlocking tongue portion 50. The outer layer 20 may be formed to extend in a direction perpendicular to the panel face 30 rearwardly towards the insulating layer 24 to form the interlocking tongue portion. The outer layer 20 may extend from the panel face 30 rearwardly toward the inner insulating layer 24 and after a certain rearward distance reverse direction back toward the front surface of the panel at an acute angle to form a tapered head of the interlocking tongue portion. The tapered head of the interlocking tongue portion 50 may have a geometry that complements a geometry of the interlocking groove portion 42 of the first longitudinal edge to enable like panels to be assembled together. The tapered head of the tongue portion 50 may be configured to engage the locking projection 48 disposed between the first longitudinal edge interlocking groove portion 42 and mounting surface portion 44. The tongue portion 50 and/or groove portion 42 may be formed from a resilient material to enable the tapered head of the tongue portion to be deflected as necessary during insertion of the tongue into the groove to form the interlocked assembly.

Figure 9:
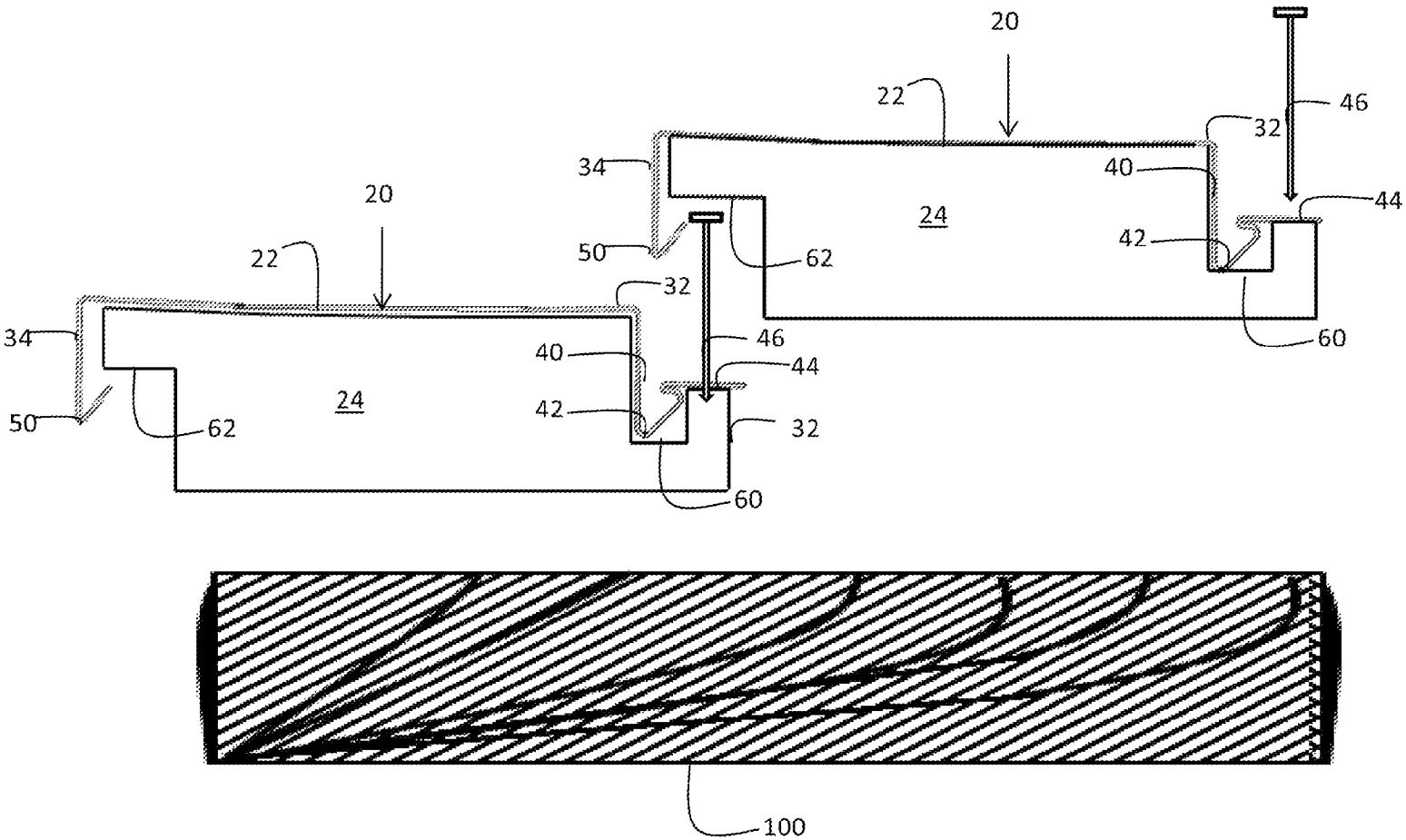
FIG. 9 shows a top view of like panels of section of cladding prior to assembly.
Figure 10:
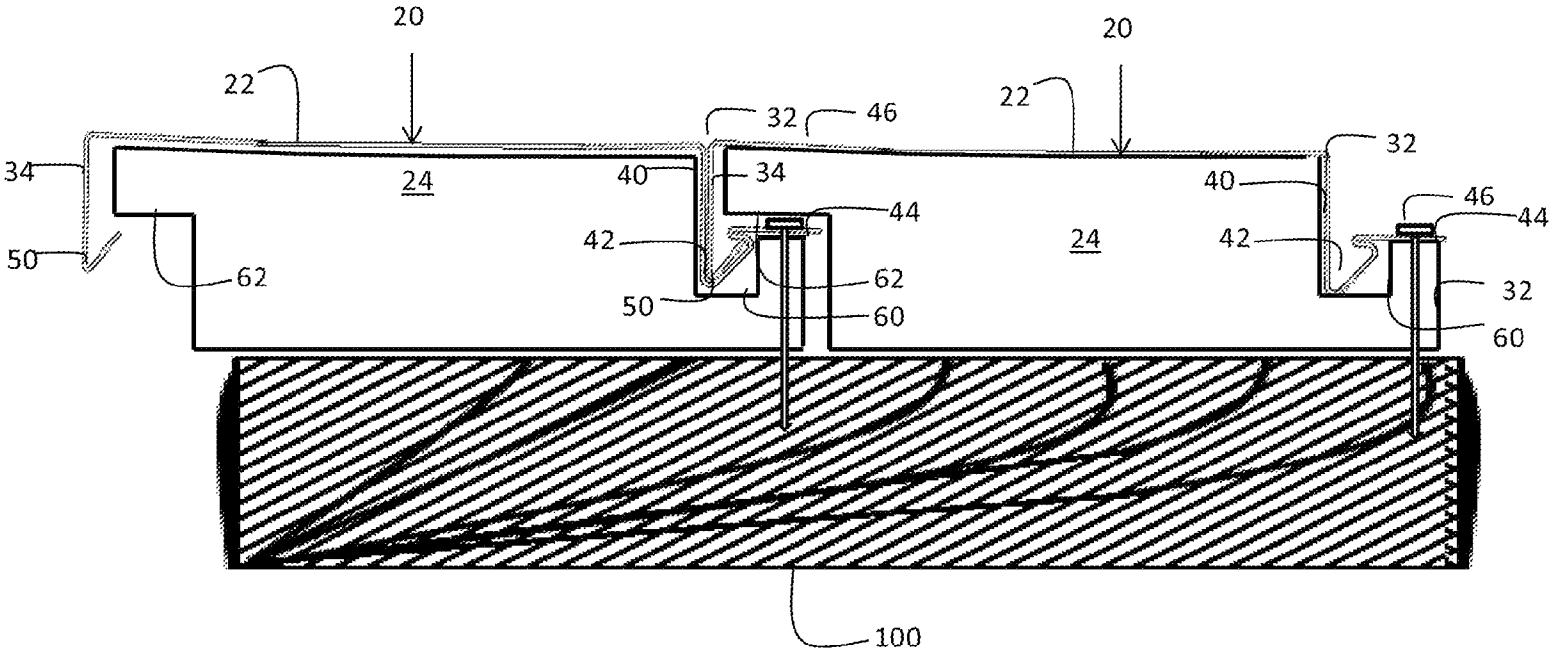
FIG. 10 shows the like panels of FIG. 9 assembled.

The insulating layer 24 may have a notch 60 formed adjacent the panel first longitudinal edge 32. Preferably, the notch 60 accommodates the web and/or the interlocking groove portion 42 of the panel first longitudinal edge 32. To provide maximum insulating capability, the insulating layer 24 may extend adjacent to the mounting surface portion 44 of the first longitudinal edge. The insulating layer may abut the mounting surface portion 44 to form a flat reference surface to enable the panel to be mounted to a structure 100 with mechanical fasteners 46 (FIGS. 9,10). The insulating layer 24 may have a recess 62 adjacent the second longitudinal edge 34. The recess 60 is dimensioned and configured to receive the first longitudinal edge web mounting portion of a like panel when like panels are assembled. As shown in FIGS. 9 and 10, the mounting surface portion 44 of the first longitudinal edge of one of the panels is arranged to fit in the recess 62 of the second panel second longitudinal edge 34. Accordingly, the insulating layers are arranged such that adjacent panels may be mounted flush or in a co-planar manner with only the insulating layer abutting the structure 100.

As shown in the drawings, the web 40 extends along the entire length of the first longitudinal edge 32. Alternatively, the web may be intermittently spaced along the longitudinal edge. Alternatively, the web may extend along a majority of the longitudinal edge. As shown in the drawings, the interlocking tongue portion 50 extends along the entire length of the second longitudinal edge 34. Alternatively, the tongue portion may be intermittently spaced about the second longitudinal edge. In such a configuration the tongue portion may be formed in a pattern that cooperates with the interlocking groove of the first longitudinal edge to enable like panels to be assembled. In an alternative construction, the tongue portion may be intermittently spaced along the second longitudinal edge and the interlocking groove may extend along the entire first longitudinal edge. The interlocking cooperating features of the first and second interlocking edges need only be arranged in a manner to allow like panels to be assembled.

As shown in the drawings, the web 42 and interlocking tongue portions 50 extend perpendicularly to the panel face. Alternatively, the web and tongue portions may be formed at acute angles relative to the panel face. The drawings show the mounting surface portion 44 substantially parallel to the plane defined by the panel face 30. Alternatively, the mounting portion may be formed at an acute angle relative to the panel face.

As described herein, when like panels are assembled, the like adjacent panels are generally coplanar and/or mounted flush relative to each other. Because the panels are mounted flush or coplanar to one another, there is improved streamlining and resistance to wind. Also, because the panels lay flatter against the structure, there is improved streamlining and resistance to wind. The interlocked panels provides less air and water migration. Additionally, because the seams of the interlocked panels may be arranged vertically, any water ingress into the seam may be easily drained. Because the panels are arranged vertically, any variation in color or shade between adjacent panels is less likely to be perceived relative to traditional horizontal siding installations.

Figure 11:
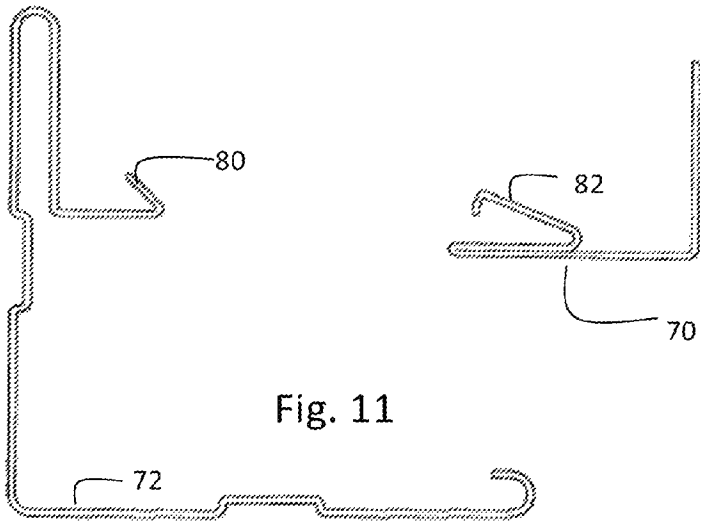
FIG. 11 shows cross-sectional views of a corner trim piece and mounting piece that may be used in connection with the interlocking panel described herein.
Figure 13:
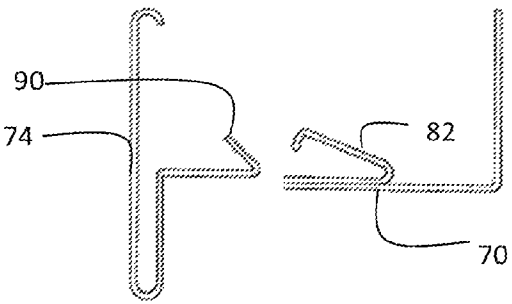
FIG. 13 shows cross-sectional views of a double lateral edge trim piece and the mounting piece of FIG. 11 that may be used in connection with the interlocking panel described herein.
Figure 14:
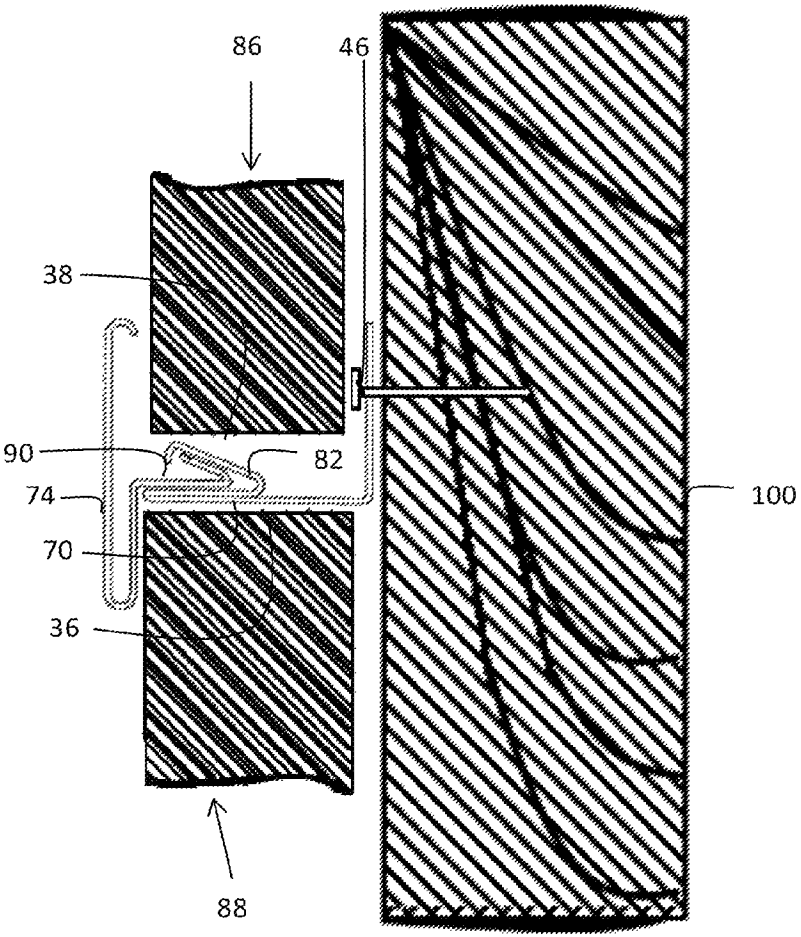
FIG. 14 shows a cross sectional view of the double lateral edge trim piece and the mounting piece of FIG. 12 mounted on a structure.
Figure 15:
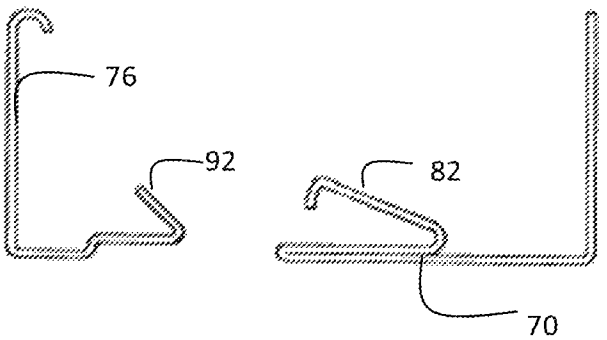
FIG. 15 shows a cross sectional view of a single lateral edge trim piece and the mounting piece of FIG. 12.

FIGS. 11-16 show trim pieces and cooperating mounting pieces that may be used with the panel 20 and/or another type panel of like dimensions. FIG. 11 shows a mounting piece 70 that may be universally used to mount a corner trim piece 72 (FIG. 11), a double lateral edge trim piece 74 (FIG. 13), or a single lateral edge trim piece 76 (FIG. 15). The mounting piece 70 may be secured on the structure 100 and provide an anchor for the corner trim piece 72, the double lateral edge piece 74, and the single lateral edge piece 76.

Figure 12:
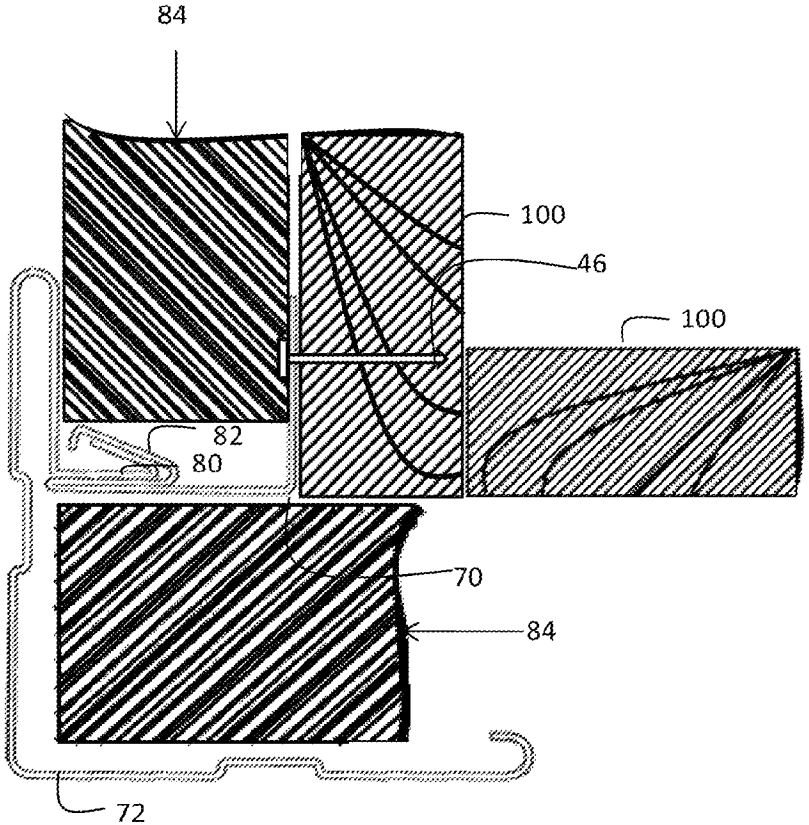
FIG. 12 shows a cross sectional view of the corner trim piece and mounting piece of FIG. 11 mounted on a structure.

As shown in FIGS. 11 and 12, the corner trim piece 72 is formed to interlock with the mounting piece 70. The corner trim piece 72 has a tongue portion 80 which may be inserted into a groove portion 82 of the mounting piece 70 to maintain adjacent corner panels 84 (for instance, of the type indicated previously by reference character 20) in a fixed position.

As shown in FIGS. 13 and 14, the double lateral edge trim piece 74 may be interlocked with the mounting piece 70 to provide an aesthetic border between vertically adjacent panels 86, 88 (for instance, of the type indicated previously by reference character 20). The double lateral edge trim piece 74 has a tongue portion 90 which is received in the groove portion 82 of the mounting piece 70. A bottom lateral width edge 38 of the top adjacent panel 86 may be received in a top space formed by the assembly, and top lateral width edge 36 of the bottom adjacent panel may be received in a bottom space formed by the assembly.

Figure 16:
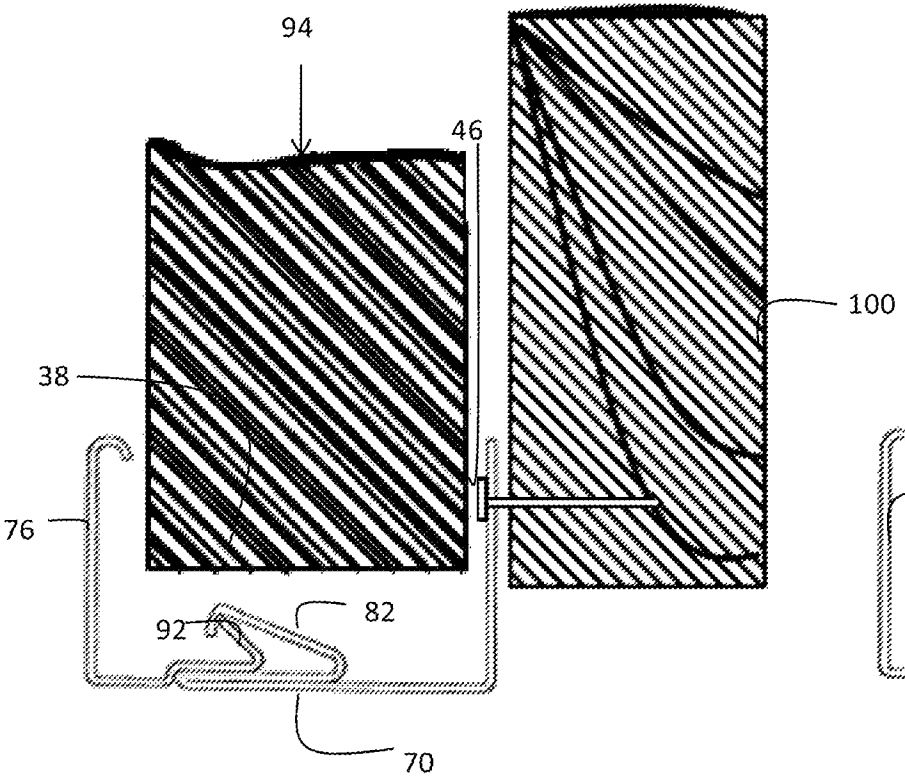
FIG. 16 shows a cross sectional view of the single lateral edge trim piece and the mounting piece of FIG. 15 mounted on a structure.

As shown in FIGS. 15 and 16, the single lateral edge trim piece 76 may be interlocked with the mounting piece 70 to provide an aesthetic border at either the top or bottom lateral width edges of the panels, depending upon its orientation. FIGS. 15 and 16 show the lateral bottom width edge configuration. Rotating the components about the horizontal axis would enable their use in a lateral top edge configuration. The single lateral edge trim piece 76 has a tongue portion 92 which is received in the groove portion 82 of the mounting piece 70. A bottom lateral width edge 38 of a panel 94 (for instance, of the type indicated previously by reference character 20) may be received in a space formed by the assembly.

In view of the foregoing, it will be seen that several advantages are achieved and attained. The embodiments were chosen and described to provide the best examples and their practical application to thereby enable others skilled in the art to best utilize the various embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A system comprising:

an anchor trim piece having a mounting portion adapted to be mounted to a structure and an interlocking portion formed on an anchor trim piece web member, the anchor trim piece web member being generally perpendicular to the anchor trim piece mounting portion; and an exterior trim piece having a first exterior face portion and an interlocking portion formed on an exterior trim piece web member, the exterior trim piece web member being generally perpendicular to the exterior trim piece exterior face portion, the first exterior face portion being exposed when the exterior trim piece is interlocked with the anchor trim piece and the anchor trim piece is mounted to the structure;

wherein the interlocking portions of the exterior trim piece and the anchor trim piece comprise cooperating tongue and groove portions, the groove portion having a groove opening that is substantially perpendicular to the anchor trim piece mounting portion and the exterior trim piece exterior face portion such that the tongue and groove portions are engagable with each other in a direction that is substantially perpendicular to the anchor trim piece mounting portion and the exterior trim piece exterior face portion, and wherein the exterior trim piece is enabled to be assembled with the anchor trim piece by engaging the exterior trim piece interlocking portion with the anchor trim piece interlocking portion;

wherein the cooperating tongue and groove portions of the exterior trim piece and the anchor trim piece are configured in a way that when the exterior trim piece and the anchor trim piece are interlocked together, the exterior trim piece exterior face portion is generally parallel to the anchor trim piece mounting portion with the anchor trim piece web member and the exterior trim piece web member generally parallel to each other and perpendicular to the exterior trim piece exterior face portion and the anchor trim piece mounting portion.

2. The system of claim 1, wherein the interlocking portion of the anchor trim piece extends along at least a majority of a length of the anchor trim piece.

3. The system of claim 1, wherein the mounting portion of the anchor trim piece extends along at least a majority of a length of the anchor trim piece.

4. The system of claim 1, wherein the interlocking portion of the exterior trim piece extends along at least a majority of a length of the exterior trim piece.

5. The system of claim 1, wherein the exterior trim piece has a second exterior face portion arranged perpendicular to the plane defined by the first exterior face.

6. The system of claim 5, wherein the first and second exterior face portions have a face channel.

7. The system of claim 1, wherein the exterior trim piece first exterior face portion and the exterior trim piece interlocking portion have a coterminous edge.

8. The system of claim 1, wherein the exterior trim piece interlocking portion extends perpendicularly from a position substantially aligned with a center of the exterior trim piece first exterior face portion.

9. The system of claim 1, wherein the exterior trim piece and anchor trim piece are configured to form a siding channel between the exterior trim piece exterior face portion and the anchor trim piece mounting portion when the exterior trim piece interlocking portion and anchor trim piece interlocking portion are interlocked together, the siding channel being dimensioned to receive a siding panel therein.

10. A system comprising:

an anchor trim piece having a mounting portion adapted to be mounted to a structure and an interlocking portion formed on an anchor trim piece web member, the anchor trim piece web member being perpendicular to the anchor trim piece mounting portion, and an exterior trim piece having a first exterior face portion, a second exterior face portion arranged perpendicular to a plane defined by the first exterior face, and an exterior trim piece interlocking portion, the first and second exterior face portions being exposed when the exterior trim piece is interlocked with the anchor trim piece and the anchor trim piece is mounted to the structure, the exterior trim piece interlocking portion having an exterior trim piece web member formed thereon, the exterior trim piece web member being generally perpendicular to a plane defined by the exterior trim piece first exterior face portion, the exterior trim piece web member being generally parallel to a plane defined by the second exterior face portion;

wherein the anchor trim piece web member is perpendicular to the plane defined by the exterior trim piece first exterior face portion when the exterior trim piece and anchor trim piece are assembled together;

wherein the exterior trim piece and anchor trim piece are configured to form a first siding channel between the exterior trim piece first exterior face portion and the anchor trim piece mounting portion when the exterior trim piece interlocking portion and anchor trim piece interlocking portion are interlocked together; and a second siding channel between the exterior trim piece second exterior face portion and portions of the exterior trim piece and anchor trim piece web members when the exterior trim piece interlocking portion and anchor trim piece interlocking portion are interlocked together, the siding channels being dimensioned to receive a siding panel therein; and wherein the interlocking portions of the exterior trim piece and the anchor trim piece comprise cooperating tongue and groove portions, the groove portion having a groove opening that is substantially perpendicular to the anchor trim piece mounting portion and the exterior trim piece exterior face portion such that the tongue and groove portions are engagable with each other in a direction that is substantially perpendicular to the anchor trim piece mounting portion and the exterior trim piece first exterior face portion, and wherein the exterior trim piece is enabled to be assembled with the anchor trim piece by engaging the exterior trim piece interlocking portion with the anchor trim piece interlocking portion in a manner such that the exterior trim piece first exterior face portion is generally parallel to the anchor trim piece mounting portion with the anchor trim piece web member and the exterior trim piece web member generally parallel to each other and perpendicular to the exterior trim piece first exterior face portion and the anchor trim piece mounting portion.

11. The system of claim 10, wherein the interlocking portion of the anchor trim piece extends along at least a majority of a length of the anchor trim piece.

12. The system of claim 10, wherein the mounting portion of the anchor trim piece extends along at least a majority of a length of the anchor trim piece.

13. The system of claim 10, wherein the interlocking portion of the exterior trim piece extends along at least a majority of a length of the exterior trim piece.

14. The system of claim 10, wherein the exterior trim piece first and second exterior face portions have a face channel.

15. A system comprising:

an anchor trim piece having a mounting portion adapted to be mounted to a structure and an interlocking portion formed on an anchor trim piece web member, the anchor trim piece mounting portion being perpendicular to the anchor trim piece web member; and an exterior trim piece having an exterior face portion and an interlocking portion formed on an exterior trim piece web member, the exterior trim piece exterior face portion and the exterior trim piece web member being arranged perpendicular to each other and having a coterminous edge, the exterior face portion being exposed when the exterior trim piece is interlocked with the anchor trim piece and the anchor trim piece is mounted to the structure;

wherein the anchor trim piece web member is perpendicular to a plane defined by the exterior face portion when the exterior trim piece and anchor trim piece are assembled together;

wherein the exterior trim piece exterior face portion and the anchor trim piece mounting portion are generally parallel to each other when the exterior trim piece interlocking portion and anchor trim piece interlocking portion are interlocked together;

wherein the interlocking portions of the exterior trim piece and the anchor trim piece comprise cooperating tongue and groove portions, the groove portion having a groove opening that is substantially perpendicular to the anchor trim piece mounting portion and the exterior trim piece exterior face portion such that the tongue and groove portions are engaqable with each other in a direction that is substantially perpendicular to the anchor trim piece mounting portion and the exterior trim piece exterior face portion, and wherein the exterior trim piece is enabled to be assembled with the anchor trim piece by engaging the exterior trim piece interlocking portion with the anchor trim piece interlocking portion; and wherein the exterior trim piece and anchor trim piece are configured to form a siding channel between the exterior trim piece exterior face portion and the anchor trim piece mounting portion when the exterior trim piece interlocking portion and anchor trim piece interlocking portion are interlocked together, the siding channel being dimensioned to receive a siding panel therein.

16. The system of claim 15, wherein the interlocking portion of the anchor trim piece extends along at least a majority of a length of the anchor trim piece.

17. The system of claim 15, wherein the mounting portion of the anchor trim piece extends along at least a majority of a length of the anchor trim piece.

18. The system of claim 15, wherein the interlocking portion of the exterior trim piece extends along at least a majority of a length of the exterior trim piece.

19. A system comprising:

an anchor trim piece having a mounting portion adapted to be mounted to a structure and an interlocking portion formed on an anchor trim piece web member, the anchor trim piece mounting portion being generally perpendicular to the anchor trim piece web member; and an exterior trim piece having an exterior face portion and an interlocking portion formed on an exterior trim piece web member, the exterior trim piece web member extending in a direction generally perpendicularly from a position substantially aligned with a center of the exterior face portion, the exterior face portion being exposed when the exterior trim piece is interlocked with the anchor trim piece and the anchor trim piece is mounted to the structure;

wherein the anchor trim piece web member is perpendicular to the plane defined by the exterior face portion when the exterior trim piece and the anchor trim piece are assembled together;

wherein the exterior trim piece exterior face portion and the anchor trim piece mounting portion are generally parallel to each other when the exterior trim piece interlocking portion and anchor trim piece interlocking portion are interlocked together;

wherein the interlocking portions of the exterior trim piece and the anchor trim piece comprise cooperating tongue and groove portions, the groove portion having a groove opening that is substantially perpendicular to the anchor trim piece mounting portion and the exterior trim piece exterior face portion such that the tongue and groove portions are engagable with each other in a direction that is substantially perpendicular to the anchor trim piece mounting portion and the exterior trim piece exterior face portion, and wherein the exterior trim piece is enabled to be assembled with the anchor trim piece by engaging the exterior trim piece interlocking portion with the anchor trim piece interlocking portion; and wherein the exterior trim piece and anchor trim piece are configured to form first and second siding channels between the exterior trim piece exterior face portion and the anchor trim piece mounting portion when the exterior trim piece interlocking portion and anchor trim piece interlocking portion are interlocked together, the first and second siding channels being generally parallel to each other, the siding channels being dimensioned to receive a siding panel therein.

20. The system of claim 19, wherein the interlocking portion of the anchor trim piece extends along at least a majority of a length of the anchor trim piece.

21. The system of claim 19, wherein the mounting portion of the anchor trim piece extends along at least a majority of a length of the anchor trim piece.

22. The system of claim 19, wherein the interlocking portion of the exterior trim piece extends along at least a majority of a length of the exterior trim piece.

* * * * *